United States Patent [19]

Muszlay

[11] Patent Number: 4,778,406

[45] Date of Patent: Oct. 18, 1988

[54] ELECTRICAL CONNECTOR

[75] Inventor: Steven Z. Muszlay, Huntington Beach, Calif.

[73] Assignee: ITT Corporation, New York, N.Y.

[21] Appl. No.: 51,544

[22] Filed: May 19, 1987

[51] Int. Cl.[4] ..... H01R 4/24

[52] U.S. Cl. ..... 439/425; 439/428

[58] Field of Search ..... 439/387, 411, 412, 415, 439/416, 417, 425, 427, 428, 429, 430, 431, 271–277, 461, 393, 434, 389, 424, 426

[56] References Cited

U.S. PATENT DOCUMENTS

| | | | |
|---|---|---|---|
| 2,675,531 | 4/1954 | Sams et al. | 439/427 |
| 3,042,892 | 7/1962 | Hayworth | 439/427 |
| 3,411,129 | 11/1968 | Peters | 439/427 |
| 4,032,210 | 6/1977 | Vogt | 439/425 |
| 4,352,240 | 10/1982 | Komada | 439/427 |

FOREIGN PATENT DOCUMENTS

| | | | |
|---|---|---|---|
| 078788 | 7/1962 | France | 439/427 |

*Primary Examiner*—David Pirlot
*Attorney, Agent, or Firm*—T. L. Peterson

[57] ABSTRACT

A connector is disclosed for making electrical connection between a wire and a cable in which the conductor of the cable is offset from the center axis of the cable. The connector comprises a contact having a pointed spike on its front face which is offset from the center axis of the contact the same distance as the offset of the conductor of the cable so that the contact can be oriented with its axis concentric with the center axis of the cable, and the spike aligned with the conductor of the cable. The connector also includes a housing which is rotatable with respect to the contact, and has self-threading screw threads on its inner wall which threadedly engage the jacket of the cable to secure the contact against the end of the cable with the spike engaging the cable conductor. The screw threads provide a sealing enagement between the connector housing and the cable jacket.

18 Claims, 3 Drawing Sheets

FIG. 2
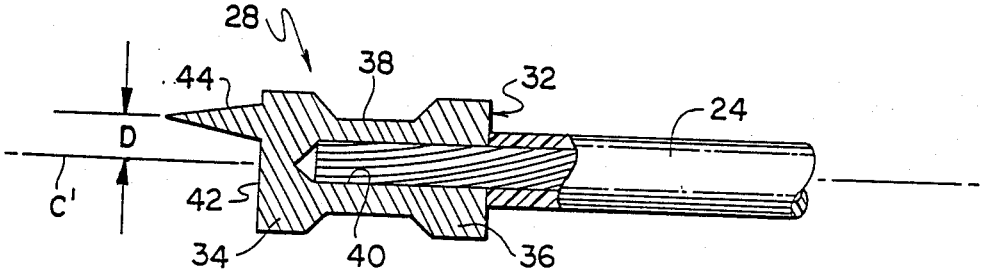
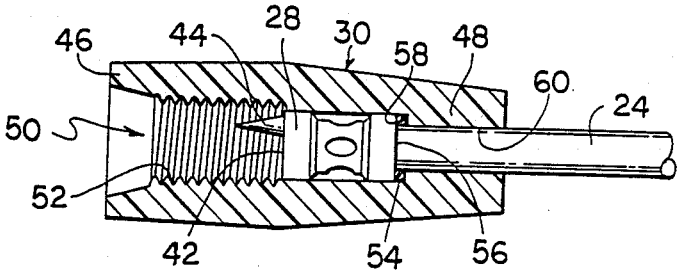
FIG. 3
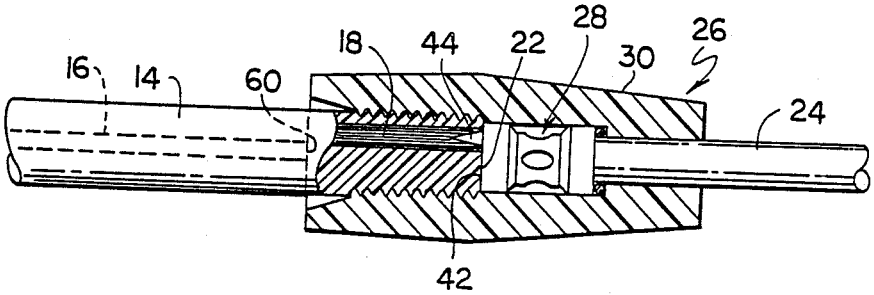
FIG. 4

FIG. 5
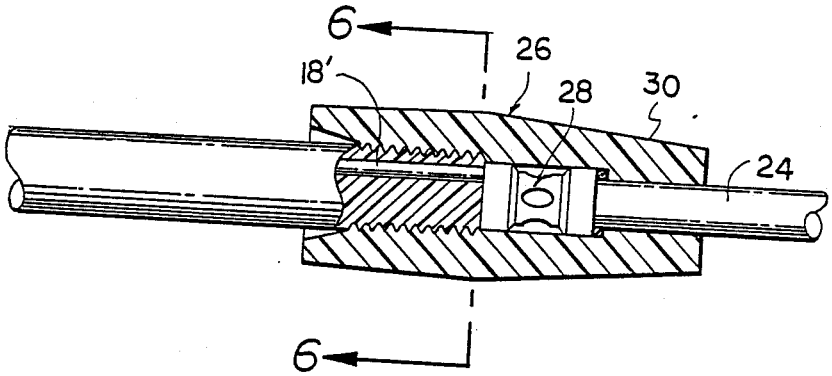
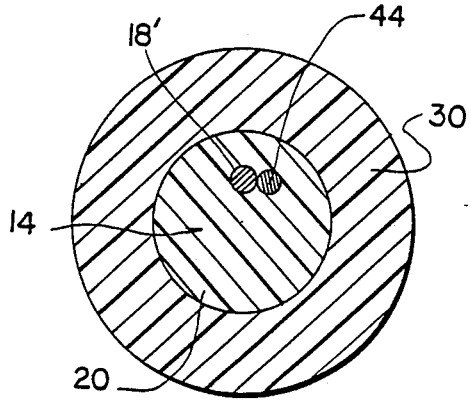
FIG. 6
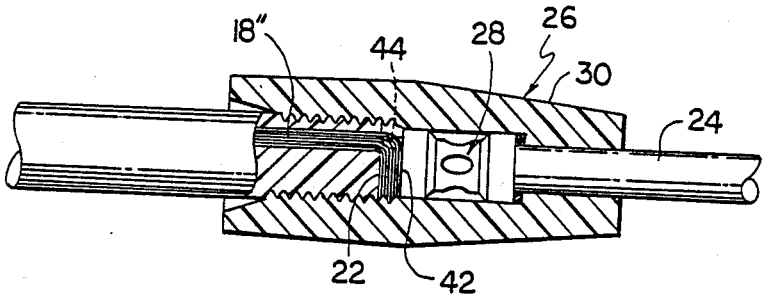
FIG. 7

ELECTRICAL CONNECTOR

BACKGROUND OF THE INVENTION

The present invention relates generally to an electrical connector and, more particularly, to a connector which may make electrical connection to a cable having a conductor offset from the center axis of the cable.

There is presently available a cathodic protection system for preventing corrosion of the reinforcing steel in concrete contaminated by salt. This system utilizes an anode device that is connected to a low voltage DC power source. The anode comprises two wires embedded in a flat conductive polymer strip. The anode is similar in appearance to a conventional flat electrical cable having round conductors joined by a plastic web. A plurality of anodes is provided in 10 foot strips for convenience in mounting the anodes against a concrete slab. Connecting links are required to interconnect the adjacent strips.

Unlike a conventional flat cable, in the aforementioned anode the wires are embedded in circular cable-like sections of the anode offset from the center axis of such cable sections, that is, in an eccentric manner. In the past electrical connection between each anode conductor and the connecting link between adjacent anode strips has been made by use of a mating pair of electrical connector plug and receptacle members. To connect one of the connector members to the anode conductor, it has been necessary to strip the jacket from the end of the conductor and crimp a pin contact onto the bared end of the conductor. The contact is then inserted into the housing of a connector member which then can be connected to the mating half of the connector on the connecting link which contains a socket contact. This assembly procedure is time consuming. Further, such arrangement requires two pairs of mating connector halves for connecting one line of conductors at the junction of two anodes, which adds to the expense of the anode connecting arrangement.

It is the object of the present invention to provide an electrical connector which may connect a wire to a cable having a conductor eccentrically mounted therein in a simple and inexpensive manner, yet provide a good electrical connection between the cable conductor and the wire and also a sealing engagement between the parts.

SUMMARY OF THE INVENTION

According to a principal aspect of the present invention, there is provided an electrical connector for connecting a wire to a cable, such as is provided by an anode of the type that is described above, having a conductor covered by a jacket with the conductor offset from the center axis of the cable a predetermined distance. Thus, the conductor is eccentrically positioned in the cable. The connector includes a contact and a hollow housing surrounding the contact, and rotatable relative thereto. The contact has a front face which abuts the end of the cable, and a rear portion which is connected to a wire. The forward portion of the housing is formed with internal self-threading screw threads for making a threaded connection directly to the jacket of the cable. A pointed spike extends forwardly from the front face of the contact. The spike is offset from the center axis of the contact a distance corresponding to the spacing between the conductor and the center axis of the cable. Thus, the contact may be oriented concentric with the center axis of the cable, with its spike aligned with the eccentric conductor of the cable. With the contact so positioned, the housing is rotated so that its self-threading screw threads will cut its own matching threads on the cable jacket, thereby carrying the housing of the connector onto the cable. As the housing is threaded onto the cable, the spike engages the conductor of the cable. Good electrical connection is provided between the spike and the connector of the cable due to the fact that when the housing is threaded onto the cable jacket, the jacket is squeezed radially inwardly to force the spike and the conductor into tight electrical contact with each other. Such connector is relatively simple in structure, inexpensive to manufacture and conveniently provides contact between a contact and cable conductor without the need for terminating a second contact to the cable conductor, which has been the practice in the past. Further, by having the housing of the connector self-threaded onto the jacket of the cable, a good sealing engagement is provided between the connector and the cable.

Other objects, aspects and advantages of the invention will become apparent from the following description taken in connection with the accompanying drawings.

BRIEF DESCRIPTION OF THE DRAWINGS

FIG. 2 is a partial longitudinal sectional view through the contact of the connector of the present invention, showing the contact positioned over the bare end of an insulated wire, prior to the contact being crimped to the wire;

FIG. 3 is a partial longitudinal sectional view through the connector of the invention with the contact crimped to the wire of the connecting link;

FIG. 4 is a partial longitudinal sectional view showing how the connector of the invention is connected to one of the cables of the anode having a stranded wire conductor;

FIG. 5 is a partial longitudinal sectional view similar to FIG. 4 but showing the connector connected to a cable having a solid wire conductor rather than stranded wire;

FIG. 6 is a transverse sectional view taken along lines 6—6 of FIG. 5 showing how the spike of the contact engages the side of the solid wire of the cable; and FIG. 7 shows the connector of the invention connected to a different form of cable in which the end of the conductor is bent over the end face of the cable jacket.

DESCRIPTION OF THE PREFERRED EMBODIMENTS

Figure 1:
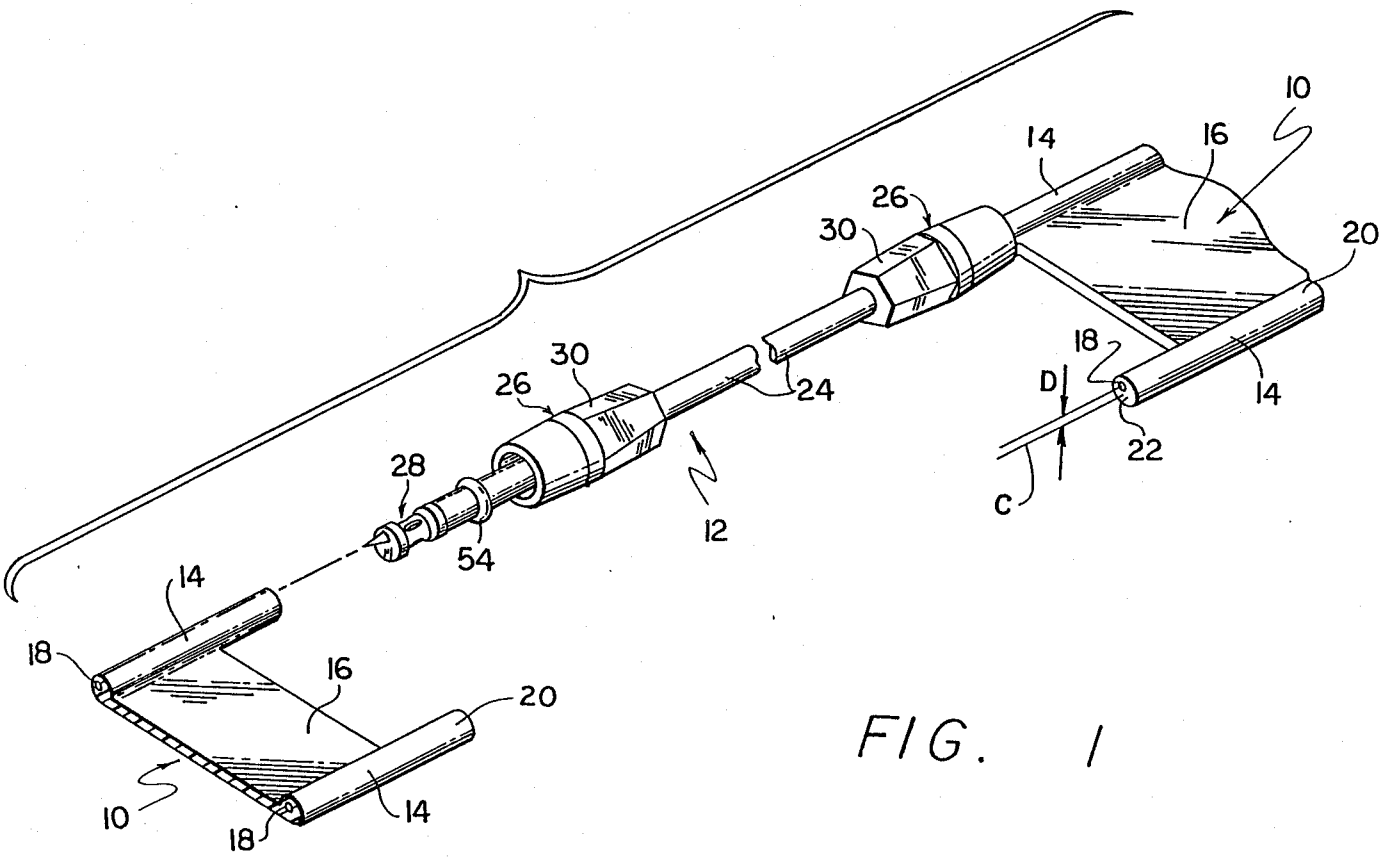
FIG. 1 is an exploded view showing a cable assembly including the ends of two anodes and a connecting link embodying the connectors of the present invention at its opposite ends.

Referring now to the drawings in detail, there is illustrated in FIG. 1 the ends of two anode strips 10 each having a pair of conductors which are connected by a pair of connecting links 12, only one being illustrated. Each anode 10 comprises a pair of cables 14 joined by a web 16. Each cable comprises a conductor 18 covered by a jacket 20. In practice, the web and jacket of the cables of an anode are formed of a conductive polymer, such as a plastic filled with carbon. However, it will be appreciated that the connector of the present invention is not limited to use with an anode device, but may also be used with any electrical cable such as one having a conductor covered by an insulative jacket, rather than a conductive polymer. The significant difference between the anode or cable used with the connector of the present invention and a conventional electrical cable is the fact that the conductor 18 is offset from the center axis C of its corresponding cable 14 so the conductor is eccentrically mounted in the cable jacket. As seen in FIG. 1, the conductor is offset from the center axis a predetermined distance D. The purpose of the eccentric mounting of the conductor in the cable of the anode is to space the conductor as far from the concrete as possible, where cathodic reaction occurs, when the anode is mounted with its lower surface against a concrete slab. Typically the conductor is a stranded wire having its end flush with the end face 22 of the cable 14. However, as will be explained later herein, the conductor could also be a solid wire.

The connecting link 12 comprises an insulated wire 24 having connectors 26 mounted on its opposite ends. The connectors may be identical. Each connector comprises a contact 28 and a hollow insulative housing 30 which is rotatably mounted with respect to the contact.

Referring now to FIG. 2 of the drawings, each contact 28 comprises a generally cylindrical body 32, preferably formed of a copper alloy, which has a relatively rigid forward section 34, a relatively rigid rear section 36 and an intermediate deformable section 38. The outer diameters of the forward and rear sections of the contact body are slightly less than the outside diameter of the cable 14. A bore 40 extends forwardly from the rear of the contact body, and terminates behind the flat front face 42 of the body. The bore is dimensioned to slidably receive the bare end of the wire 24. It is seen that the intermediate section 38 of the contact body has a reduced wall thickness, which allows such section to be readily deforeed by crimping to secure the contact to the wire.

The front face 42 of the contact body is normal to the center line C' of the contact. According to an important feature of the invention, a pointed spike 44 extends forwardly from the front face of the contact. The spike is preferably in the form of a right circular cone. The spike is offset from the center axis C' a distance D which is the spacing between the center line C and the conductor 18 of the cable 14.

Referring now to FIG. 3 of the drawings, it is seen that the housing 30 of the connector has a forward portion 46 and a rear portion 48, and a passage, generally designated 50, that extends axially through the housing. The forward end of the passage 50 in front of the front face 42 of the contact is formed with self-threading screw threads 52 which are shaped and dimensioned to self-thread upon the jacket 20 of the cable 14 when the housing is rotated in a predetermined direction, typically clockwise, over the end of the cable. The threads serve to hold the housing on the cable. Further, upon self-threading of the housing onto cable jacket, the polymer jacket flows to fill the threads on the housing thereby providing an effective environmental seal at the connection of the housing with the cable. Preferably, the root or valley of the screw threads 52 is rounded, rather than pointed, to enhance the seal. A sealing ring 54 is located between a rearwardly facing annular shoulder 56 provided by the rear of the contact body and a forwardly facing annular shoulder 58 formed in the rear portion of the housing. The rear 60 of the passage 50 in the housing is dimensioned to have a close sliding fit with the insulated wire 24. When the housing is tightly threaded onto the cable, the sealing ring 58 is compressed between the shoulders 56 and 58, causing the ring to deform radially inwardly and sealingly engage the outer surface of the insulated wire, thereby environmentally sealing the rear of the connector.

To assemble the connector 26 to the cable 14, initially the housing 30 is retracted rearwardly over wire 24, as seen in FIG. 1, to expose the contact 28. The operator then aligns the spike 28 of the contact with the conductor 18 of the cable with the contact body generally concentric with the center axis of the cable. The operator then presses the contact toward the cable to cause the spike to enter the stranded wire conductor. The housing is then brought up over the contact and rotated clockwise so that the housing will self-thread upon the cable jacket. Rotation of the housing is continued until the front face 42 of the contact abuts the end face 22 of the cable, at which time the spike 44 will be fully inserted into the interior of the cable conductor. While the housing is threaded over the cable jacket, the jacket is compressed radially inwardly to squeeze the wires of the conductor into firm engagement around the spike, thereby producing a good electrical connection between the cable conductor and the contact. Once the housing is fully threaded on the cable, the resulting connection is fully sealed due to the engagement of the threads 52 with the cable jacket and the compression of the sealing ring 54 at the rear of the housing.

Reference is now made to FIGS. 5 and 6 of the drawings, which show the connector of the present invention connected to a modified form of cable 14, wherein the conductor 18' of the cable is a solid wire rather than a stranded wire. The connector 26 is the same as described previously herein. The only difference in operation between this embodiment of the invention and the first embodiment is that, rather than the spike 44 of the connector entering the interior of a stranded wire of the cable, as seen in FIG. 6 the spike is caused to enter along the side of the solid wire conductor 18'. Good electrical connection between the spike and the wire is achieved by the inward compression of the cable jacket 20 upon threading of the connector housing onto the cable, causing the spike to be held firmly against the surface of the wire.

In the embodiment illustrated in FIG. 7, the connector 26 is as previously described, and the conductor 18'' of cable 14 is a stranded wire, with the end of the wire extending beyond the end face 22 of the cable jacket and bent at a right angle over such face so that the end of the wire is trapped between the end face of the cable and the flat face 42 of the contact when the housing is engaged over the cable. Thus, in this embodiment electrical engagement is provided both by the insertion of the spike 44 into the stranded wire, and abutment of the front face of the contact against the bent end the wire.

Preferably, the web 16 of the anode is cut away from the end of the anode so that the edge 60 of the web is spaced rearwardly from the end faces 22 of the cables 14. As best seen in FIG. 4, the edge 60 is located a predetermined distance from the end faces of the cables so that when the front face 42 of a contact firmly abuts the end face of a cable, the front edge of the connector housing 30 will simultaneously abut the edge 60 of the web 16. Thus, when the operator threads the housing over the cable to the point that the front dge of the housing abuts the edge 60 of the web 16 of the cable, he is assured that complete engagement is made between the contact and the conductor of the cable.

While the present invention has been described as comprising a connecting link for interconnecting a pair of anodes used for cathodic protection of reinforcing steel in concrete slabs, it will be appreciated that the connecting link of the invention can also be used for simply interconnecting a pair of electrical cables having insulative jackets, provided that the conductors in the cables are eccentric with respect to the center axes of the cables. Further, one connector 26 alone may be used to connect one cable having a concentric conductor to a second cable having a conductor eccentrically located therein.

Although several embodiments of the invention have been disclosed herein for purposes of illustration, it will be understood that various changes can be made in the form, details, arrangement and proportions of the various parts of such embodiments without departing from the spirit and scope of the invention as defined by the appended claims.

What is claimed is:

1. An electrical connector for connecting a wire to a cable having a conductor covered by a jacket with the conductor offset from the center axis of the cable a predetermined distance comprising:

a contact having a front face adapted to abut the end of said cable, and a rear portion adapted to be connected to a wire;

a hollow insulative housing surrounding said contact and rotatable with respect to said contact;

a forward portion of said housing being formed with internal self-threading screw threads for making a threaded connection to the jacket of said cable; and a pointed spike extending forwardly from said front face of said contact, said spike being offset from the center axis of said contact a distance corresponding to said predetermined distance, whereby said contact may be oriented so that said spike will engage the conductor of said cable when the housing is threaded onto said cable.

2. An electical connector asset forth in claim 1 wherein:

said front face of said contact is flat and extends normal to said center axis of the contact.

3. An electrical connector as set forth in claim 1 wherein:

said spike is shaped as a right circular cone.

4. An electrical connector as set forth in claim 1 wherein:

said contact has a rearwardly facing annular shoulder thereon;

said housing has a forwardly facing annular shoulder thereon behind said contact shoulder; and a sealing ring is positioned between said shoulders.

5. An electrical connector as set forth in claim 1 wherein:

said contact embodies relatively rigid forward and rear sections and an intermediate deformable section adapted to be crimped to a wire.

6. An electrical contact for connecting a wire to a cable having a conductor covered by a jacket with the conductor offset from the center axis of the cable a predetermined distance comprising:

a contact body having a front face adapted to abut the end of said cable and a rear portion adapted to be connected to a wire;

a pointed spike extending forwardly from said front face of said contact body, said spike being offset from the center axis of said contact body a distance corresponding to said predetermined distance, whereby said contact body may be oriented with its center axis coaxial with the center axis of the cable, and with said spike positioned to engage the conductor of the cable; and said contact body embodying relatively rigid forward and rear sections and an intermediate deformable section adapted to be crimped to a wire.

7. A cable assembly comprising:

a cable having a conductor covered by a jacket with the conductor offset from the center axis of the cable a predetermined distance;

a connector attached to a wire to be connected to said cable conductor, said connector comprising:

(i) a contact having a front face abutting the end of said cable, and a rear portion connected to said wire;

(ii) a hollow insulative housing surrounding said contact and rotatable with respect to said contact;

(iii) a forward portion of said housing being formed with internal self-threading screw threads having a threaded connection to said jacket of said cable; and (iv) a pointed spike extending forwardly from said front face of said contact, said spike being offset from the center axis of said contact a distance corresponding to said predetermined distance, said contact being oriented so that said spike engages said conductor of said cable.

8. A cable assembly as set forth in claim 7 wherein:

said front face of said contact is flat and extends normal to said center axis of said contact.

9. A cable assembly as set forth in claim 7 wherein:

said spike is shaped as a right circular cone.

10. A cable assembly as set forth in claim 7 wherein:

said contact has a rearwardly facing annular shoulder thereon;

said housing has a forwardly facing annular shoulder thereon behind said contact shoulder; and a sealing ring is compressed between said shoulders to deform the ring into sealing engagement with said wire.

11. A cable assembly as set forth in claim 7 wherein;

said contact embodies relatively rigid forward and rear sections and an intermediate deformable section crimped to said wire.

12. A cable assembly as set forth in claim 7 wherein:

the end of said conductor is flush with said end of said cable.

13. A cable assembly as set forth in claim 7 wherein:

the end of said conductor extends beyond and is bent over said end of said cable and is trapped between said end of said cable and said front face of said contact.

14. cable assembly as set forth in claim 7 wherein:

said conductor is a stranded wire; and said spike extends into the interior of said stranded wire.

15. a cable assembly as set forth in claim 7 wherein:

said conductor is a solid wire; and said spike extends along the outer surface of said wire.

16. A cable assembly as set forth in claim 7 wherein:

said cable has a web thereon integral with said jacket; and said web having an edge spaced rearwardly from said end of said cable a predetermined distance such that the forward end of said housing will engage said edge when said front face of said contact abuts the end of said cable.

17. A cable assembly comprising:

a cable having a single wire covered by an insulative jacket with the wire offset from the center axis of the cable a predetermined distance;

a contact having a flat front face normal to the center axis of said contact and abutting the end of said cable, and said contact having a rear portion connected to a conductor to be connected to said wire; and a single pointed spike extending forwardly from said front face of said contact, said spike being offset from said center axis of said contact a distance corresponding to said predetermined distance, said contact being oriented so that said spike engages said wire of said cable.

18. A cable assembly as set forth in claim 17 including:

coupling means on said contact directly engaging said jacket to hold said front face of said contact in abutment with said end of said cable.

* * * * *